US007803059B2

(12) United States Patent
Zhang

(10) Patent No.: US 7,803,059 B2
(45) Date of Patent: Sep. 28, 2010

(54) LASER BEAM METHOD AND SYSTEM FOR GOLFER ALIGNMENT

(76) Inventor: Yaohui Zhang, 23006 N. Warmstone Way, Katy, TX (US) 77494

( * ) Notice: Subject to any disclaimer, the term of this patent is extended or adjusted under 35 U.S.C. 154(b) by 533 days.

(21) Appl. No.: 11/827,327

(22) Filed: Jul. 11, 2007

(65) Prior Publication Data

US 2009/0017929 A1 Jan. 15, 2009

(51) Int. Cl.
*A63B 69/36* (2006.01)

(52) U.S. Cl. ..... 473/220; 473/226; 473/268

(58) Field of Classification Search ..... 473/219, 473/220, 226, 227, 268, 409
See application file for complete search history.

(56) References Cited

U.S. PATENT DOCUMENTS

| | | | | |
|---|---|---|---|---|
| 1,169,188 | A | 1/1916 | Peck | |
| 3,156,211 | A | 11/1964 | Malloy, Jr. | |
| 3,437,339 | A | 4/1969 | Stark | |
| 3,953,034 | A | 4/1976 | Nelson | |
| 4,079,940 | A | 3/1978 | Arakaki | |
| 4,298,201 | A | 11/1981 | Palinkas | |
| 4,303,244 | A | 12/1981 | Uppvall | |
| 4,307,885 | A | 12/1981 | Pidcock | |
| 4,406,040 | A | 9/1983 | Cannone | |
| 4,560,166 | A | 12/1985 | Emerson | |
| 4,869,509 | A | 9/1989 | Lee | |
| 5,005,835 | A | 4/1991 | Huffman | |
| 5,199,712 | A | 4/1993 | Hoyle, Jr. | |
| 5,207,429 | A | 5/1993 | Walmsley | |
| 5,284,345 | A | 2/1994 | Jehn | |
| 5,401,030 | A | 3/1995 | Halliburton | |
| 5,465,972 | A | 11/1995 | Cornett | |
| 5,467,992 | A | 11/1995 | Harkness | |
| 5,558,585 | A | 9/1996 | Nolan, Jr. | |
| 5,560,607 | A | 10/1996 | Macroglou | |
| 5,788,588 | A | 8/1998 | Hooker | |
| 5,800,278 | A | 9/1998 | Varriano | |
| 5,848,941 | A * | 12/1998 | Morra | 473/220 |
| 5,879,239 | A | 3/1999 | Macroglou | |
| 6,007,436 | A | 12/1999 | Mark | |
| 6,672,972 | B1 | 1/2004 | Stone | |
| 6,796,910 | B1 | 9/2004 | Foster | |
| 6,902,493 | B1 | 6/2005 | Rhodes | |
| 6,913,542 | B1 * | 7/2005 | Hu et al. | 473/220 |
| 7,025,688 | B1 * | 4/2006 | Hatzikostantis | 473/220 |
| 7,048,642 | B2 | 5/2006 | Burley | |
| 7,207,896 | B1 | 4/2007 | Sudol | |
| 2006/0046863 | A1 | 3/2006 | Yeh | |
| 2006/0166753 | A1 * | 7/2006 | Chan et al. | 473/220 |
| 2006/0287121 | A1 * | 12/2006 | Cameron et al. | 473/220 |
| 2009/0017929 | A1 * | 1/2009 | Zhang | 473/220 |

* cited by examiner

*Primary Examiner*—Raleigh W. Chiu
(74) *Attorney, Agent, or Firm*—Gordon G. Waggett, P.C.

(57) ABSTRACT

An improved static alignment and an improved dynamic alignment are combined in a laser beam method and system that provides instantaneous and continuous information feedback to a golfer to allow the real time correction of defects arising from a golfer's stance, head movement, body movement, golf club alignment, and golf club swing.

13 Claims, 8 Drawing Sheets

LASER BEAM METHOD AND SYSTEM FOR GOLFER ALIGNMENT

FIELD OF INVENTION

This invention relates generally to a method and system for guiding a golfer in achieving proper body alignment for efficient pitching, chipping, and putting strokes, and specifically to a laser beam device that provides instantaneous feedback that may quickly be deciphered to correct any deviation from both an optimum stance at the initial set up before a golf club swing, and optimum head and body movement during the golf club swing.

BACKGROUND OF THE INVENTION

The fundamentals of golf that are generally taught include a correct grip of a golf club, proper alignment of the body, and the ability to keep one's head steady during a golf club swing or putting stroke. The ability to consistently achieve these fundamentals will assist a golfer of any age and experience to improve his overall score.

Proper alignment of the head, body and golf club before a golf club swing is executed (static alignment), and thereafter during the execution of the golf club swing (dynamic alignment), help in maintaining the necessary consistency. What has been missing is a teaching aid that provides sufficient, continuous, and instantaneous feedback to a golfer during both static alignment and dynamic alignment to allow immediate corrections to stance, head movement, body movement, and golf club swing to achieve improvements while engaged in a practice session or golf game.

Numerous methods and devices are known that attempt to assist a golfer in improving the golfer's alignment either at the golf tee or during a golf club swing. Such devices include masking devices to limit the golfer's view, laser line projecting devices to illuminate a desired golf ball path, pendulum-like devices fixed to a golfer's hat to indicate head movement, audible alarm devices fixed to a golfer's cap or eye glass frame to detect head movement, and light emitting diode devices for detecting head or body movement during a golf swing.

Each of the known methods and devices are limited to sensing and providing feedback on a single alignment characteristic (e.g. audible alarm or pendulum device indicating the occurrence of head movement, illumination by laser of desired golf ball path, laser beam projection for alignment of feet prior to static alignment), or two alignment characteristics (e.g. projection of light spot on ball to indicate head or body movement). None sense and provide to the golfer continuous and immediate feedback on four essential alignment characteristics (target direction alignment, club face alignment, body alignment, and swing axis alignment), as does the present invention, so that the golfer may instantaneously incorporate real time alignment corrections during both static alignment and dynamic alignment to achieve accurate and consistent performance.

Further, the known prior art addresses only one of pre-static alignment, static alignment, and dynamic alignment, but none fully addresses either the improved static alignment of the present invention at the time the golf ball is first addressed or the improved dynamic alignment of the present invention during the execution of the golf club swing, and none address both static alignment and dynamic alignment as does the present invention. A successful launching of a golf ball by a golfer requires both static and dynamic alignment.

SUMMARY OF THE INVENTION

A light weight, laser beam projecting device is disclosed that is easily fitted to the bill or visor of a cap, or to a shaft of a golf putter, without blocking a golfer's vision, and that projects two laser beams onto the hitting surface on the ground where the golf ball is located. One beam provides a straight line projection that is aligned with the desired travel path of the golf ball. The second laser beam provides a straight line projection that is parallel to the club face of the golf club or putter, and that perpendicularly intersects the straight line projection of the first laser beam.

More particularly, a laser light source is connected to an optical lens assembly comprised of two sets of concave lenses that are placed side by side, with the face of each set of lenses being perpendicular to the laser beam produced by the light source. The optical lens assembly refracts the laser beam into two laser beam lines, one perpendicular to the other to form a laser T projection on the ground. The laser T projection in turn may be rotated into any orientation. By so orientating the laser T projection, one of the laser beam lines may be aligned with a desired golf ball travel direction. The projection of the laser T upon the ground in front of the golfer provides a visual aid to align the club or putter strike face perpendicular to the desired golf ball travel direction, and parallel to the second laser beam line that points to the golfer. The golfer's body also may be aligned with respect to the golf ball travel direction and the second laser beam line. Upon completing the above alignments, a static alignment is said to have occurred with the golfer's feet, knees, hips, shoulders, and head becoming aligned to improve a golfer's ability to properly strike a golf ball.

After static alignment, the success of a golfer in having his golf club strike a golf ball, and launch the ball toward the desired target position, largely depends upon the golfer's ability to keep his head still while focusing his eyes upon the golf ball, and to keep his body aligned and rotated within a desired swing axis during the golf club swing. By such alignment, referred to as a dynamic alignment, a steady swing axis is created with the golfer's head positioned at the origin of the axis, and the golf club swing occurring along a desired plane of the swing axis. The steadiness of the swing axis in turn allows the golfer's body to turn in the direction of the desired golf ball travel line to generate the power needed to hit the ball onto the desired target position.

More particularly, an optimum golf club swing occurs when the swing axis remains still, while the golf club is rotating with the golfer's arm and body along a plane of the swing axis that allows the golfer to execute his back swing and down swing within the plane. As before stated, the golfer's head is the hub of the swing axis. Any movement of the feet, knees, hips, shoulders, or head will directly translate into movement of the swing axis That is, the swing axis may move away from its original position during both the back swing and the down swing, as well as the follow through swing of the golf club. Through use of the method and system disclosed and claimed herein, however, a laser T projection is produced to provide the golfer a continuous visual ground projection that may be readily deciphered to correct in real time any undesired head or body movement. The swing axis thereby may be stabilized so that the golf club, and the arms and the body of the golfer, can rotate along a desired plane of the swing axis.

The invention is directed to a laser beam projection system for indicating errors in both static and dynamic alignment of a golfer's head, body, and golf club, that comprises a power source, a pair of conducting lines, a laser light source connected by way of said pair of conducting lines to said power source for receiving an electrical current to generate a laser beam, and an optical lens system mechanically connected to said laser light source for refracting said laser beam to produce a laser T projection. The above system is used in accordance with a method of statically aligning a golfer's head, body, and golf club, that comprises the steps of energizing the laser beam projection system to produce a laser T projection that is superimposed on a golf ball mounted on a golf tee, centering a cross-point of the laser T projection on said golf ball, orienting the laser T projection to align a first arm of the laser T projection to point to the golfer, and to align a second arm of the laser T projection parallel to a desired travel path of said golf ball, and perpendicular to the first arm, observing rectilinear and rotational movement of the laser T projection to correct deficiencies in static alignment during a golfer's stance in addressing the golf ball before a golf club swing occurs, and performing a dynamic alignment by observing rectilinear and rotational movement of the laser T projection during a golf club swing and correcting that movement of the golfer's head, body, and golf club that prevent the golf club swing from occurring along a desired plane of a swing axis having the golfer's head at its origin.

BRIEF DESCRIPTION OF THE DRAWINGS

The present invention may be best understood by reference to the accompanying drawings in which.

DESCRIPTION OF PREFERRED EMBODIMENTS

Preferred embodiments of the invention are now described with reference to the drawings to enable any person skilled in the art to make and use the invention. In the description, same components of the preferred embodiments are referred to by same reference numbers.

Figure 1:
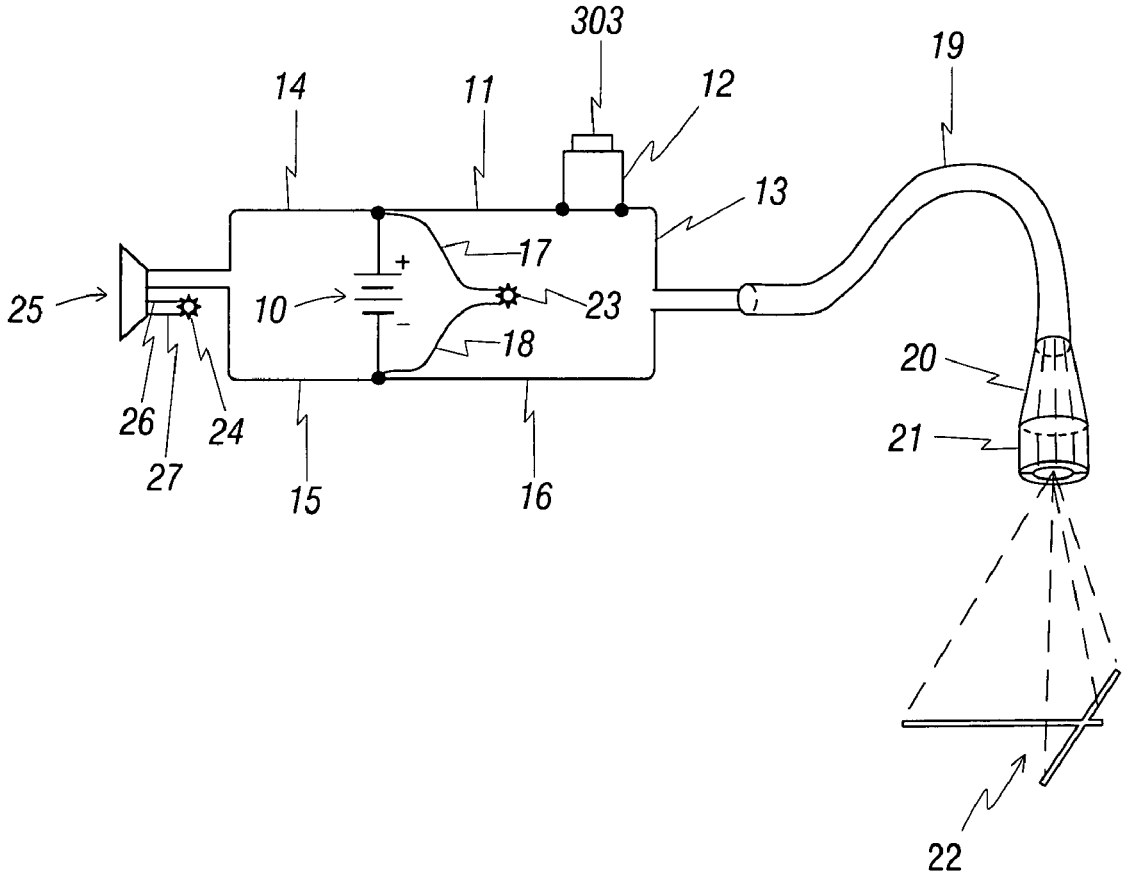
FIG. 1 is an electro-mechanical schematic of the laser beam projection system in accordance with the invention.

Referring to FIG. 1, the positive terminal of a power source 10 is shown to be connected by way of a conducting line 11 to one terminal of a time control switch 12. The other terminal of the time control switch 12 is connected by way of a conducting line 13 to the positive terminal of a laser light source 20 by way of a flexible and twistable conduit 19 that may be repeatedly bent in shape. The time control switch 12 is operated by depressing a push button 303. Each time the push button 303 is depressed, the time control switch 12 connects conducting line 11 to the laser light source 20, thereby allowing the power source 10 to energize laser light source 20 for 10 to 15 seconds. The golfer thereby has an opportunity to recover from a stressful condition before again depressing push button 303, and resuming his/her alignment and golf club swing. The negative terminal of power source 10 is connected by way of conducting line 16 through the flexible conduit 19 to a negative terminal of the laser light source 20. One end of the flexible conduit 19 is mechanically attached to the outer surface of the laser light source 20, and the other end is mechanically attached to a housing (not shown) that protects the conducting lines 13 and 16 from damage when the flexible conduit 19 is re-shaped.

A cylindrical optical lens system 21 is attached mechanically to the laser light source 20 in the path of the laser beam. The optical lens system 21 is comprised of two side-by-side clusters of concave lenses, with each cluster including at least three side-by-side concave lenses. When one cluster of lenses is oriented orthogonal to the other, the laser beam produced by the laser light source 20 is refracted by the lens system 21 to create a T-shaped beam that is projected to the ground as laser T projection 22. The projection is visible to the naked eye even in daylight.

Continuing with the description of FIG. 1, one terminal of a power indicator 23 is connected by way of a conducting line 17 to conducting line 11 and the positive terminal of power source 10, and the other terminal of the power indicator 23 is connected by way of a conducting line 18 to conducting line 16 and the negative terminal of power source 10. The power indicator 23 provides a visible indication of the power level of the power source 10. That is, the power indicator 23 emits a visible light so long as the power source 10 is operating at a voltage level that will energize the laser source 20.

The positive terminal of power source 10 also is connected by way of a conducting line 14 to one port of a USB charging port 25, and the negative terminal of power source 10 also is connected by way of a conducting line 15 to the other terminal of the USB charging port 25.

When the USB charging port 25 is plugged into a power source (not shown), and the output voltage of the power source 10 is low, the power source 10 is charged to the voltage level required to energize the laser light source 20.

The USB charging port 25 includes a charging light indicator 24 that is connected to the USB charging port 25 by way of conducting lines 26 and 27.

Figure 2A:
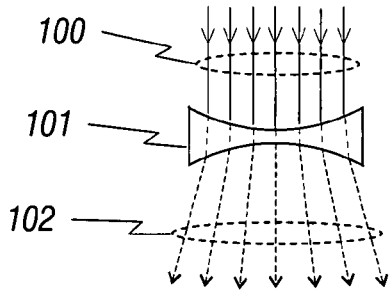
FIG. 2A illustrates the effect of a concave lens on a laser beam.
Figure 2B:
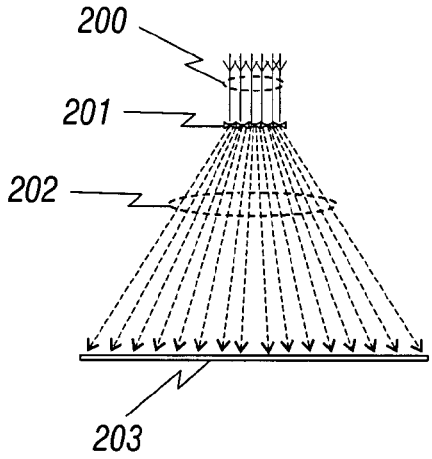
FIG. 2B illustrates the effect of a cluster of side-by-side concave lenses on a laser beam.

Referring to FIG. 2A, when a laser light beam 100 is directed through a concave lens 101, the individual rays of the light beam are refracted as shown by ray pattern 102. In FIG. 2B, a dot laser beam 200 is directed through a cluster of side-by-side concave lenses 201. As a result, the individual light rays of the laser beam are refracted as shown by the ray pattern 202 to produce a straight line beam projection 203.

Figure 2C:
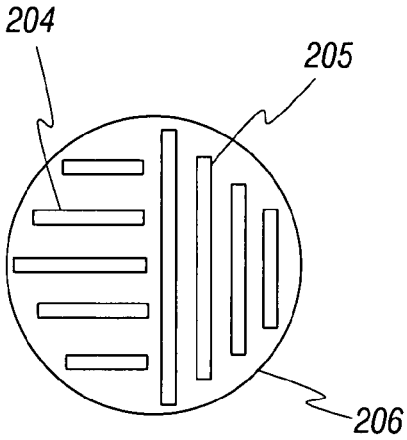
FIG. 2C is a perspective view looking down on side-by-side clusters of concave lenses, with one cluster being oriented perpendicular to the other.

In FIG. 2C, two concave lens clusters 204 and 205 are placed side by side and oriented perpendicular to each other within a cylindrical case 206.

Figure 2D:
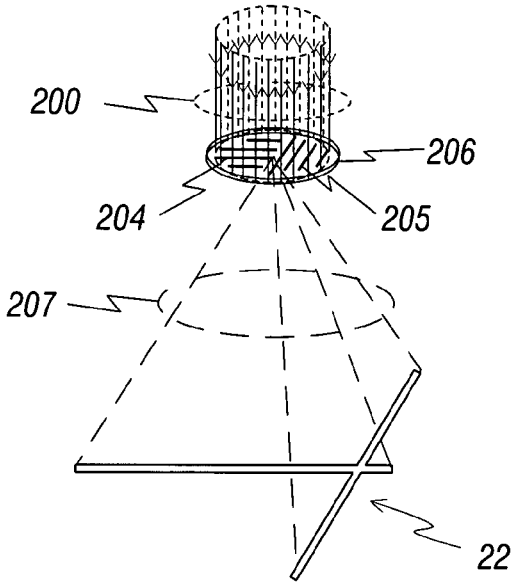
FIG. 2D illustrates the effect of the two clusters of side-by-side concave lenses of FIG. 2C on a laser beam. A laser T projection is formed when a laser beam passes through the two clusters of concave lenses.

Referring to FIG. 2D, dot laser beam 200 is directed through clusters 204 and 205 to be refracted into a ray pattern 207 that produces laser T projection 22 on the ground.

In a preferred embodiment of the invention, the following Table I specifically identifies components comprising the invention.

TABLE I

| Component Name | Ref. Number | Manufacturing Source Location | Product Name/Model No. | Further Specifications As Required |
|---|---|---|---|---|
| Power Source | 10 | (1) Power Tech International, Co. LTD. Commercially available through Sinolink, LLC in the US at P.O. Box 42350, Houston, Texas 77242. Tel.: 1-281-772-8395. | (1) Rechargeable Lithium Battery (Model No. 043046) | Watts: <5 mw Volts: 3 to 4 V Amps: 20 to 80 mAh. Any low voltage DC battery, such as 1.5 V batteries used for flash lights, and rechargeable batteries (3.7 v) used for cellular phones. |
| | | (2) Lenmar Enterprises, Inc.; 4035Via Pescador; Camarillo, CA 93012 US Tel.(805)-384-9600 Fax: (805)384-9693 | (2) Lenmar Lithium Ion Cell Phone Battery (Part # CLN338) | |
| Flexible Conduit | 19 | (1) Yuyao Xin Cai Electri-Mechanical Co. Commercially available through Sinolink, LLC in the US at P.O. Box 42350, Houston, Texas 77242. Tel.: 1-281-772-8395 | (1) Flexible Conduit part no. FC8-100. | |
| | | (2) Allied Tube & Conduit at 16100 South Lathrop Avenue, Harvey, Illinois 60426 | | |
| Laser Light Source & Optical Lens System | 20, 21 | (1) Sean & Michael Corporation. Commercially available through Sinolink, LLC in the US, at P.O. Box 42350, Houston, Texas 77242. Tel: (281) 772-8395 | (1) Laser diode part # GLD4LT070415. | For indoor or dim light conditions use red light laser source, and for bnght day light conditions use green light laser source. |
| | | (2) Coherent Inc. At 5100 Patrick Henry Drive, Santa Clara, California 95054. | (2) Crosshair 635 nm 1.7 mW laser component part # FVLM2. | |
| | | (3) Shangrao Chaori Optical Mould Factory commercially available through Sinolink, LLC in The US, at P.O. Box 42350, Houston, Texas 77242. | (3) Optical lens part nos. P-35, P-58, and P-88. | |

TABLE I-continued

| Component Name | Ref. Number | Manufacturing Source Location | Product Name/Model No. | Further Specifications As Required |
|---|---|---|---|---|
| Time Control Switch With Push Button | 12, 303 | (1) Amperite Co., 4201 Tonnelle Avenue, Suite 6, North Bergen, New Jersey 07047. | (1) On-Delay Timer part nos. 12dc.1-60c, and 12D1-100-SS-T2. | |
| USB Port | 25 | Cable Wholesale.com, 208 Lindbergh Ave., Livermore, California 94551. | USB Cable part # 10U2-02106BK | |

Figure 3:
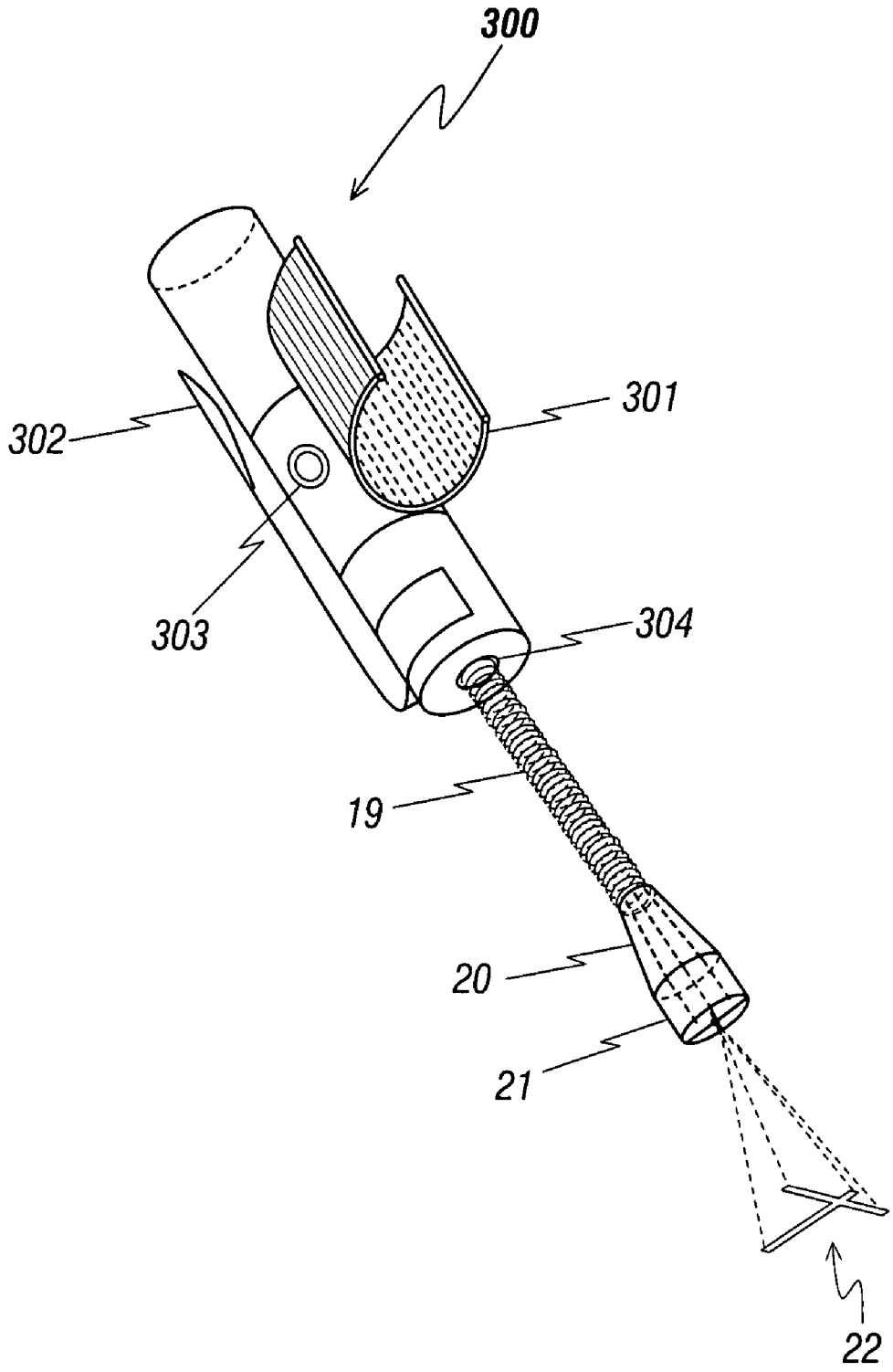
FIG. 3 is a side perspective view of an embodiment of the invention including a housing that may be attached to the bill of a cap or the handle of a golf club.

Referring to FIG. 3, a cylindrical housing 300 (housing 300 could be rectangular or of a different shape) is shown with a snap-on clip 301 for attaching the housing to a golf club handle, and a pressure clip 302 such as used with fountain pens and mechanical pencils. The clips are affixed to the housing by any conventional means including the use of adhesives or mechanical attachments, and are placed about the outer lateral surface of the housing 300 so as not to interfere with the operation of the push button 303 or ready use of either clip. Each of the clips is aligned with the longitudinal axis of the housing 300 so that when clip 302 is used, the flexible conduit 19 and the laser light source 20 extend out over the bill of a golfer's cap, and when the clip 301 is used the flexible conduit 19 and laser light source 20 point downward toward the golf club head.

The housing 300 has enclosed therein the power source 10; conducting lines 11, 13, 14, 15, 16, 17, 18, 26, and 27; all but the push button 303 of the time control switch 12; all but the plug-in face of the USB charging port 25; the charge light indicator 24; and the power indicator 23. A mechanical lock 304 attaches one end of the flexible conduit 19 to the housing 300. The flexible conduit 19 extends from mechanical lock 304 to the laser light source 20, which is mechanically connected to the optical lens system 21 as before stated in connection with the description of FIG. 1.

Figure 4A:
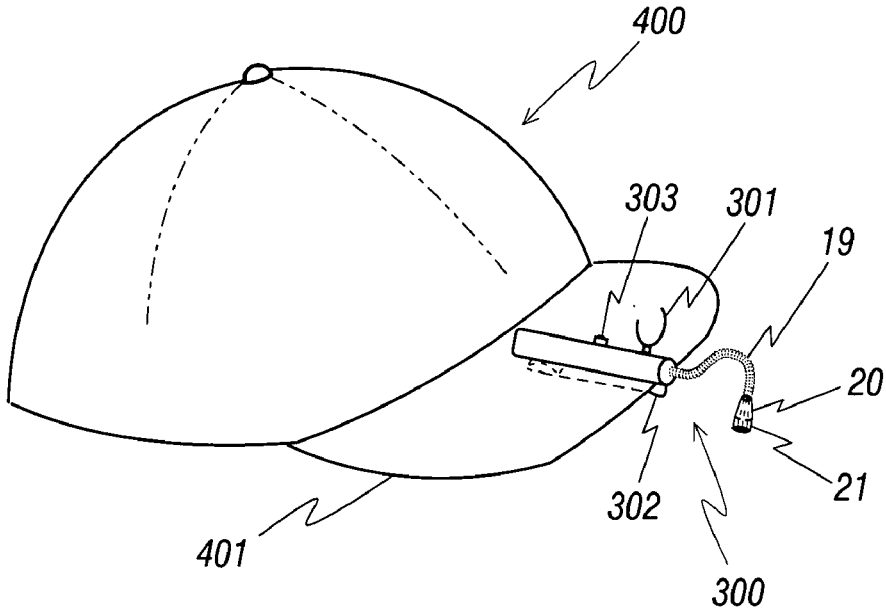
FIG. 4A is a perspective view of the housing 300 of FIG. 3 attached by pressure clip 302 to a billed cap.

Referring to FIG. 4A, a cap 400 with bill 401 is shown with cylindrical housing 300 attached to the bill 401 by pressure clip 302. In this position, the push button 303 and the clip 301 point upward away from the bill 401, and the flexible conduit 19 is bent over the outer rim of the bill as desired by the golfer to place the laser T projection 22 of FIG. 3 on the hitting surface of the ground.

Figure 4B:
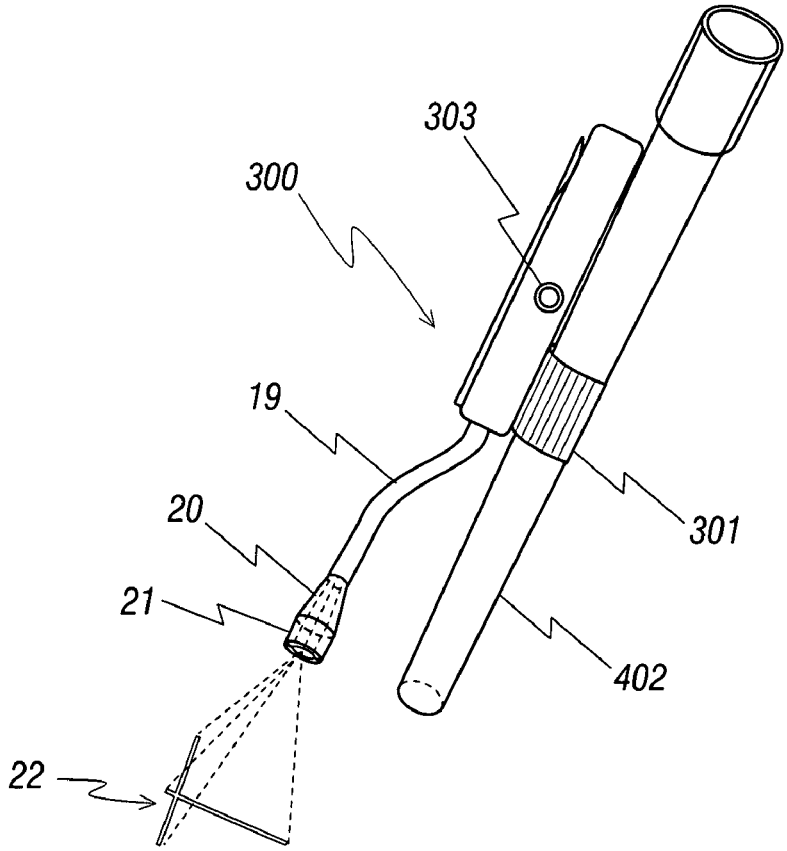
FIG. 4B is a side view of the housing 300 of FIG. 3 attached by snap-on clip 301 to the handle 402 of a golf club.

In FIG. 4B, the housing 300 is connected by way of the snap-on clip 301 to a golf club handle 402. With this embodiment, the golfer may depress the push button 303 to energize the laser light source 20, rotate the housing 300 about the handle 402, and bend the flexible conduit 19 so as to position the laser light source 20 and optical lens system 21. The laser T projection 22 thereby may be superimposed on a golf ball on the ground.

Figure 5:
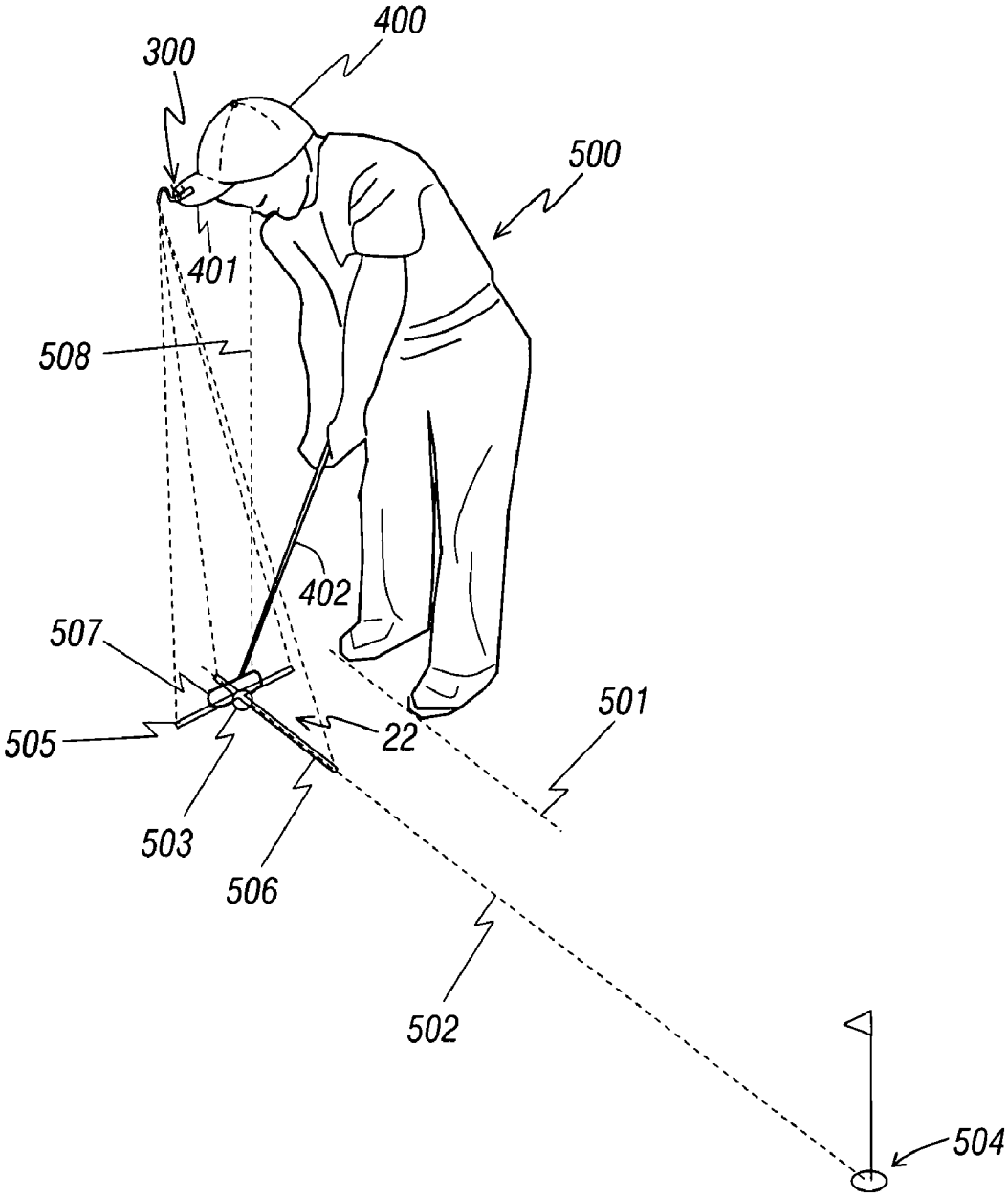
FIG. 5 is an illustration of a static alignment of a golfer on the putting green with the housing 300 of the invention being attached to a golfer's hat by means of the pressure clip 302 of FIG. 4A.

Referring to FIG. 5, a golfer 500 is shown in a position on the putting green where the toe sections of his golf shoes touch a body alignment line 501 that is parallel to a desired travel path 502 of a golf ball 503 leading to a hole 504. In this embodiment, the golfer 500 is shown wearing cap 400 with the housing 300 being attached to the bill 401 as before described. The flexible conduit 19 is bent over the rim of the bill 401 to allow the laser light source 20 with optical lens system 21 to superimpose laser T projection 22 on the golf ball 503. The optical lens system 21 and the laser light source 20 may be rotated by twisting the flexible conduit 19 to position a first arm 505 of the laser T projection 22 to point to the golfer 500. A second arm 506 of the laser T projection 22 is aligned with the desired travel path 502 of the golf ball 503, and is perpendicular to the first arm 505. With the golfer's feet positioned on either side of first arm 505 and aligned as described above relative to the line 501, the golfer 500 will grip his golf club handle 402, adjust his shoulder, hips, and legs to place the strike face of the golf club head 507 perpendicular to the second arm 506 and in alignment with the first arm 505. The golfer 500 thereafter will fix his line of sight 508 on the golf ball 503. Having completed the above positioning and orientation instructions, the golfer 500 will have achieved static alignment with optimum positioning of the feet, width of stance, body alignment, and the golf club position and orientation.

Figure 6:
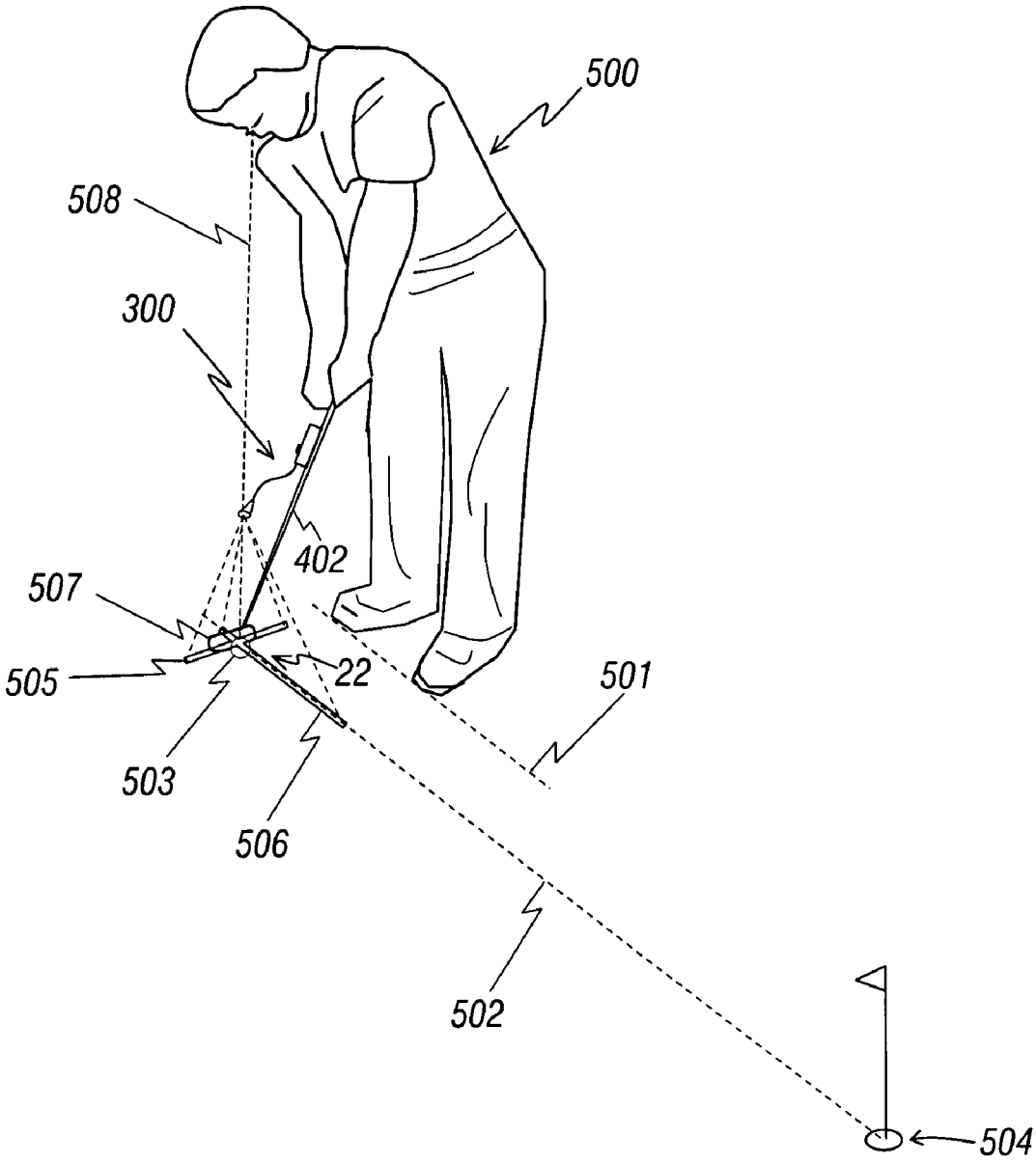
FIG. 6 is an illustration of a static alignment of a golfer on the putting green with the housing 300 of the invention being attached to the handle 402 of a golf club.

The static alignment of a golfer's stance when the housing 300 is attached to the golf club handle 402 is shown in FIG. 6, where the flexible conduit 19, laser light source 20, and optical lens system 21 are aligned with the longitudinal axis of the golf club handle 402. As before, the flexible conduit 19 is bent to allow the laser light source 20 with optical lens system 21 to superimpose the laser T projection 22 on the golf ball 503 as it sits on a golf tee or putting green. Further, the flexible conduit 19 may be twisted to rotate the optical lens system 21 and the laser light source 20 to position the first arm 505 of the laser T projection 22 to point to the golfer 500. The second arm 506 of the laser T projection 22 thereupon is aligned with the desired travel path 502 of the golf ball 503, and is perpendicular to the first arm 505. With the golfer's feet placed as described above relative to the line 501, the golfer 500 will grip his golf club handle 402, fix his line of sight 508 on the golf ball 503, adjust his shoulders, hips, and legs to hold laser T projection 22 in superposition over the golf ball 503, and place the striking face of the golf club head 507 in alignment with the first arm 505 and perpendicular to the second arm 506. Having completed the above positioning and orientation instructions, the golfer 500 will have achieved static alignment with optimum positioning of the feet, width of stance, body alignment, and golf club position and orientation.

Figure 7:
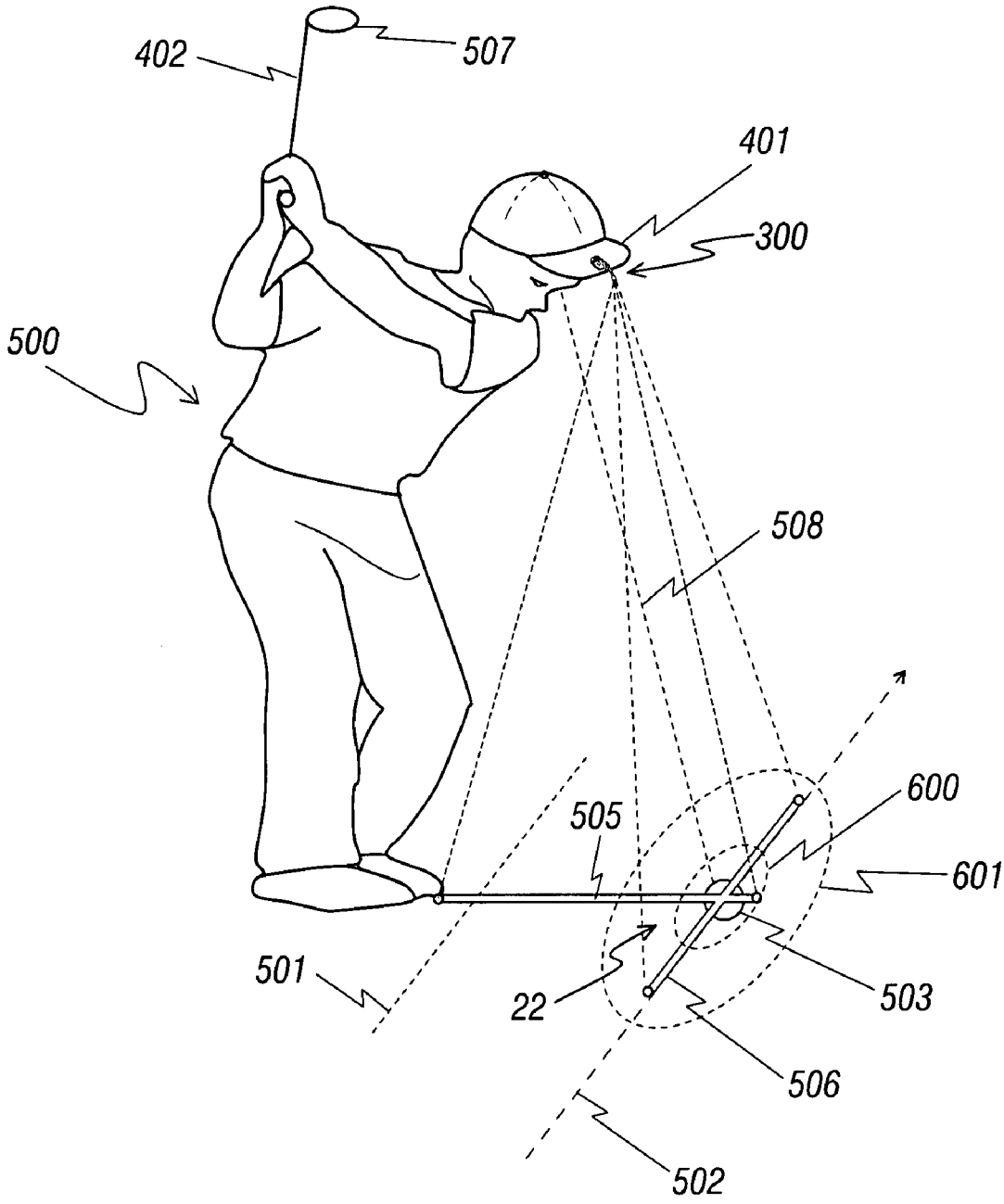
FIG. 7 is an illustration of a dynamic alignment of a golfer with the housing 300 of the invention being attached to a golfer's hat during the execution of a golf club swing.

FIG. 7 shows a golfer 500 in a position at the tee to perform a static alignment where the golfer's feet are aligned perpendicular to line 501 that is parallel to the pre-selected travel path 502 of golf ball 503. In this embodiment, the golfer 500 is shown wearing a cap with the housing 300 being attached to the bill 401 as before described. The flexible conduit 19 is bent over the rim of the bill 401 to allow the laser light source 20 with the optical lens system 21 to superimpose a laser T projection 22 on the golf ball 503 as it sits on a golf tee. The optical lens system 21 and the laser light source 20 may be rotated by twisting the flexible conduit 19 to position the first arm 505 of the laser T projection 22 to point to the golfer 500, and align the second arm 506 with a pre-selected travel path 502 of the golf ball 503.

With the golfer's feet placed on either side of the first arm 505 and aligned as before described relative to the body alignment line 501, the golfer will grip his golf club handle 402, adjust his shoulder, hips, and legs to hold the laser T projection 22 in superposition over golf ball 503, and place the strike face of the golf club head 507 in alignment with the first arm 505 and perpendicular to the second arm 506. He then will fix his line of sight 508 on the golf ball 503. The golfer 500 upon completing the static alignment described above is ready to perform a dynamic alignment that will assist the golfer in executing a golf swing and propelling the golf ball 503 along a desired travel path 502 toward a desired target.

The head or body movement of the golfer 500 during a golf club swing will directly translate into movement of the laser T projection 22 on the ground. The movement of the laser T projection 22 reflects the status of the dynamic alignment, i.e., the status of body and arm rotation along the desired plane of the swing axis. In order to achieve a dynamic alignment, the golfer 500 will have to decipher the visual information feedback of the laser T projection 22 as it moves along the ground. The laser T projection 22 acts like a video camera allowing the golfer 500 to watch himself during the swing. If the golfer 500 is able to hold his/her head still to keep the swing axis steady, the laser T projection 22 will stay as it was before the swing, and the likelihood that the golf ball 503 upon being struck by the golf club head 507 will travel along the desired travel path 502 is high. By monitoring and analyzing the path of movement of the laser T projection 22 in real time, golfer 500 can identify his swing faults and make corrections to overcome such faults. The golfer 500 thereby is aided in improving his golfing skills.

Figure 8A:
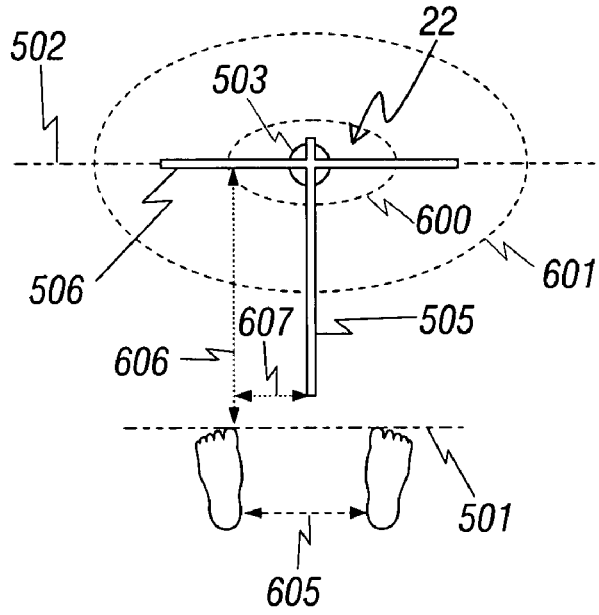
FIG. 8A illustrates a golfer's foot alignment relative to laser T projection 22, and a position of the laser T projection 22 relative to small ellipse 600 and larger ellipse 601.

FIG. 8A shows the following alignment elements: golfer's width of stance 605 as measured between the inside heel perimeters of a golfer, a distance 606 between second arm 506 of the laser T projection 22 and the body alignment line 501, a distance 607 between first arm 505 and the inside heel perimeter of the left foot for a right handed golfer (or between first arm 505 and the inside heel perimeter of the right foot for a left-handed golfer), body alignment line 501, desired travel path 502, golf ball 503, laser T projection 22, a small ellipse 600, and a larger ellipse 601. Each time a golfer addresses the golf ball 503 at static alignment, the golf ball 503 is placed on the crossing point of the first arm 505 and the second arm 506 of the laser T projection 22.

For each type of golf club, the golf ball position on the ground is important in achieving a static alignment and a dynamic alignment. In aid of a static alignment, recommended distances for width of stance 605, distance 606, and distance 607 for a plurality of golf clubs is provided in Table II below for a golfer having a height of 5'7".

TABLE II

| Club | Width Of Stance 605 (+/− one inch) | Distance 606 (+/− one inch) | Distance 607 (+/− one inch) |
|---|---|---|---|
| Wedge | 10 | 15 | 4.35 |
| 9 Iron | 10.75 | 16.5 | 3.75 |
| 8 Iron | 11.5 | 18 | 3.3 |
| 7 Iron | 12.25 | 19.5 | 2.9 |
| 6 Iron | 13 | 21 | 2.5 |
| 5 Iron | 13.75 | 22.5 | 2.1 |

TABLE II-continued

| Club | Width Of Stance 605 (+/− one inch) | Distance 606 (+/− one inch) | Distance 607 (+/− one inch) |
|---|---|---|---|
| 4 Iron | 14.5 | 24 | 1.65 |
| 3 Iron | 15.25 | 25.5 | 1.25 |
| 5 Wood | 16 | 28 | 0.8 |
| 3 Wood | 16.75 | 30 | 0.4 |
| Driver | 17.5 | 33 | 0 |

Figure 8B:
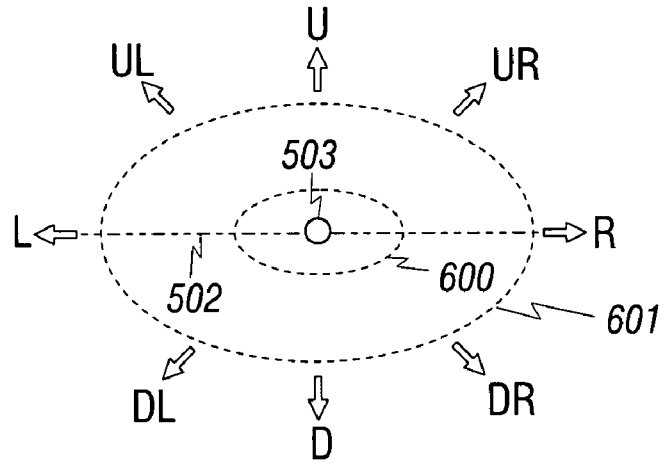
FIG. 8B is a motion graph that shows possible positions and rectilinear movements of the laser T projection 22 on the hitting surface during a golf club swing.

FIG. 8B is a motion graph that shows possible travel directions of the laser T projection 22 that may occur when errors are introduced during the execution of the golf club swing. The golfer can identify his golf club swing faults by observing the change of the position and orientation of the laser T projection 22. For example, if the laser T projection 22 is initially centered on the golf ball 503, minor movement of the head or body during an otherwise proper execution of a shoulder turning and a weight transfer may cause the laser T projection 22 to move within the small ellipse 600 that is centered at the golf ball 503. Excessive head or body movement, however, may cause the laser T projection 22 to move outside of the larger ellipse 601 that is centered at the golf ball 503. The small ellipse 600 has a minor axis diameter of approximately 3 to 5 inches, and a major axis diameter of approximately 5 to 7 inches. The larger ellipse 601 has a minor axis diameter of approximately 6 to 8 inches, and a major axis diameter of approximately 9 to 12 inches.

In FIG. 8B and Tables III and IV below, the movement of the laser T projection 22 is represented by "U" for up or northern movement, "D" for down or southern movement, "L" for left or western movement, "R" for right or eastern movement, "UL" for up-left or northwest movement, "UR" for up-right or northeast movement, "DL" for down-left or southwest movement, and "DR" for down-right or southeast movement.

Table III and Table IV are fault tables that provide further guidance for correcting errors in a golfer's dynamic alignment, as determined from observance of the rectilinear movement of the laser T projection 22.

TABLE III

Laser "T" Moving Path And Potential Swing Faults For Right-Handed Swing

| Laser T Moves to | Possible Swing Fault |
|---|---|
| U | Lifting up head with eye away from ball. |
| D | Lifting shoulders or bowing head. |
| R | Shifting body too much to the right leg, e.g. excessive weight transfer to golfer's right leg. |
| L | Weight transfer to left leg. |
| UR | Lifting head and shifting body to right leg. |
| DL | Lifting shoulders and transferring weight to left leg. |
| UL | Lifting head and transferring weight to left leg. |
| DR | Lifting shoulders and shifting the upper body to the right, with excessive weight transfer to golfer's right leg. |

TABLE IV

Laser "T" Moving Path And Potential Swing Faults For Left-Handed Swing

| Laser T Moves to | Possible Swing Fault |
|---|---|
| U | Lifting up head with eye away from ball. |
| D | Lifting shoulders or bowing head. |
| R | Weight transfer to right leg. |

TABLE IV-continued

| Laser "T" Moving Path And Potential Swing Faults For Left-Handed Swing | |
|---|---|
| Laser T Moves to | Possible Swing Fault |
| L | Shifting body too much to the right leg, e.g. excessive weight transfer to golfer's right leg. |
| UR | Lifting head and transferring weight to right leg. |
| DL | Lifting shoulders and shifting the upper body to the right, excessive weight transfer to golfer's right leg. |
| UL | Lifting head and Shifting body to left leg. |
| DR | Lifting shoulders and transferring weight to right leg. |

The object of the golfer's corrections to his dynamic alignment is to keep the laser T projection 22 aligned as described above with the body alignment line 501 and desired travel path 502, and with the cross-point of the laser T projection 22 centered on the golf ball 503 as mounted on a golf tee or located on a putting green.

The laser T projection 22 may move through several positions during the execution of a golf club swing, and such movement may indicate that the golfer has a combination of swing faults as listed in Table III or Table IV. A golfer can identify his faults during a golf club swing by repeatedly practicing with the invention, and correcting his faults as they are identified.

Figure 8C:
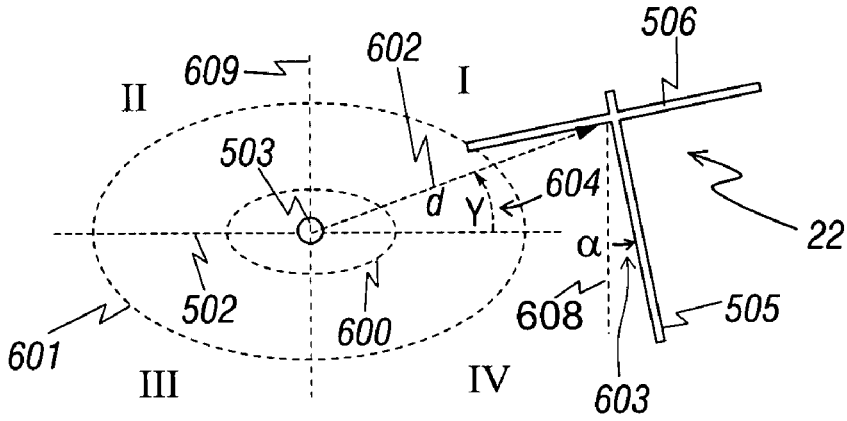
FIG. 8C is a motion graph that illustrates the use of "d", "α" and "γ" parameters in defining both rectilinear and rotational movements of the laser T projection 22 during a golf club swing.

FIG. 8C is a motion graph that illustrates three parameters that may be used to measure the laser T projection 22 rectilinear and rotational positions at a point in time as it moves in response to a golfer's head, body and golf club movements. The distance "d" is the distance 602 from the golf ball 503 to the cross-point of first arm 505 and second arm 506 of the laser T projection 22, and is proportional to a rectilinear deviation of the laser T projection 22 from its original position over the golf ball 503. The angle "α" of FIG. 8C is the counter-clockwise angle of rotation 603 of the laser T projection 22 measured from a vertical line 608 that passes through the cross-point of the laser T projection 22. The angle "γ" is the counter-clockwise angle of rotation 604 of the distance "d" measured from the zero degree or desired travel path 502.

The desired travel path 502, and a vertical line 609 that is perpendicular to the desired travel path 502 and that passes through the golf ball 503 position, divides the hitting surface on the ground into four quadrants, referred to in counter-clockwise order by the Roman numerals I, II, III, and IV.

Table V below illustrates some possible swing axis faults that provide further guidance for correcting errors in a golfer's dynamic alignment, as determined from observance of the parameters "d", "γ", and "α" in quadrants I, II, III, and IV of FIG. 8C.

TABLE V

| Relationship Between Laser T Parameters And Potential Swing Faults | |
|---|---|
| Values Of Laser T Projection 22 Parameters | Possible Swing Fault |
| "α" > 10 degrees | Improper tilt of the head during a golf club swing for both right and left handed golfers. |
| "γ" > 45 degrees in quadrants I and II, and d > 13 inches. | Lifting up head with eye away from ball for both right and left handed golfers. |
| "γ" > 45 degrees in quadrants III and II, and "d" > 13 inches. | Lifting shoulders or bowing head for both right and left handed golfers. |

TABLE V-continued

| Relationship Between Laser T Parameters And Potential Swing Faults | |
|---|---|
| Values Of Laser T Projection 22 Parameters | Possible Swing Fault |
| "γ" < 45 degrees in quadrants I and IV, and "d" > 13 inches | Shifting body too much to the right leg, e.g. excessive weight transfer to golfer's right leg for both right and left-handed golfer. |
| "γ" > 45 degrees in quadrants II and III, and "d" > 13 inches | Shifting body too much to the left leg, e.g. excessive weight transfer to golfer's left leg for both right and left handed golfer. |

By way of example with reference to Table V, if the angle of rotation "a" is greater than 10 degrees, the golfer is tilting his head in other than a straight down direction. Generally, the angle of rotation "α" ranges between 0 and 60 degrees. Further, if "d" is greater than 13 inches and "γ" is greater than 15 degrees in quadrant I, it is known that the golfer is lifting his head up and shifting his eyes away from the golf ball. A golfer may draw the ellipse 600 and the ellipse 601 on the ground, and use the invention to practice at a driving range or indoors to reduce the distance "d" to be within the ellipse 600, and minimize the angles of rotation "γ" and "α".

Although particular embodiments of the invention have been described and illustrated herein, it is recognized that modifications, variations, and equivalents may readily occur to those skilled in the art, and consequently, it is intended that the Claims be interpreted to cover such modifications, variations, and equivalents.

What is claimed is:

1. A laser beam projection system for providing instantaneous and continuous information feedback to a golfer to accommodate the identification and correction in real time of errors in both static and dynamic alignment of a golfer's head, body, golf club, and swing axis, which comprises:

a power source;

a pair of conducting lines;

a laser light source connected by way of said pair of conducting lines to said power source for receiving an electrical current to generate a laser beam;

a time control switch mechanically and electrically connected to one of said pair of conducting lines to control the flow of electrical current through said pair of conducting lines;

a housing enclosing said power source, said pair of conducting lines, and all but a push button of said time control switch; and a flexible and twistable conduit mechanically connected between said housing and said laser light source, and enclosing said pair of conducting lines to provide an electrical current to said laser light source.

2. A laser beam projection system for providing instantaneous and continuous information feedback to a golfer to accommodate the identification and correction in real time of errors in both static and dynamic alignment of a golfer's head, body, golf club, and swing axis, which comprises:

a power source;

a pair of conducting lines;

a laser light source connected by way of said pair of conducting lines to said power source for receiving an electrical current to generate a laser beam;

an optical lens system mechanically connected to said laser light source for refracting said laser beam to produce a laser T projection, a time control switch mechanically and electrically connected to one of said pair of conducting lines to control the flow of electrical current through said pair of conducting lines;

a housing enclosing said power source, said pair of conducting lines, and all but a push button of said time control switch; and a flexible and twistable conduit mechanically connected between said housing and said laser light source, and enclosing said pair of conducting lines to provide an electrical current to said laser light source.

3. The laser beam projection system of claim 2 above, further comprising:

a snap-on clip mechanically attached to said housing for securing said laser projection system to a handle of a golf club; and a pressure clip mechanically attached to said housing for securing said laser projection system to a bill of a golf cap.

4. The laser beam projection system of claim 2 above, further comprising:

a power indicator electrically and mechanically connected in parallel to said power source;

a USB charging port electrically and mechanically connected in parallel to said power source to recharge said power source; and a charging light indicator electrically and mechanically connected in parallel to said USB charging port.

5. A laser beam projection system for providing instantaneous and continuous information feedback to a golfer to accommodate the identification and correction in real time of errors in both static and dynamic alignment of a golfer's head, body, golf club, and swing axis, which comprises:

a power source;

a pair of conducting lines;

a laser light source connected by way of said pair of conducting lines to said power source for receiving an electrical current to generate a laser beam; and an optical lens system mechanically connected to said laser light source for refracting said laser beam to produce a laser T projection, wherein said optical lens system is comprised of two clusters of concave lenses, with each of said two clusters including at least three side-by-side concave lenses, and with one of said two clusters being oriented orthogonal to the other, to refract said laser beam to provide a visible laser T projection.

6. The laser beam projection system of claim 2, wherein said laser light source produces a red laser beam for use at night and in the event of dim daylight conditions.

7. The laser beam projection system of claim 2, wherein said laser light source produces a green laser beam for use in bright daylight conditions.

8. A laser beam projection system for providing instantaneous and continuous information feedback to a golfer to accommodate the identification and correction in real time of errors in both static and dynamic alignment of a golfer's head, body, golf club, and swing axis, which comprises:

a housing;

a laser light source;

a flexible conduit mechanically connected at a first end to said housing and at a second end to said laser light source;

a power source located in said housing;

a pair of conducting lines connecting said laser light source to said power source to provide electrical current to said laser light source; and an optical lens system mechanically connected to said laser light source for refracting said laser beam to produce a laser projection.

9. The laser beam projection system of claim 8 wherein said laser projection is a single straight line beam projection.

10. The laser beam projection system of claim 9 wherein said optical lens system is comprised of a cluster of side-by-side concave lenses, with each of said two clusters including at least three side-by-side concave lenses to refract said laser beam to provide a single straight line beam projection.

11. The laser beam projection system of claim 8 wherein said laser projection is a laser T projection.

12. The laser beam projection system of claim 11 wherein said laser projection is a laser T projection wherein said optical lens system is comprised of two clusters of concave lenses, with each of said two clusters including at least three side-by-side concave lenses, and with one of said two clusters being oriented orthogonal to the other, to refract said laser beam to provide a visible laser T projection.

13. The laser beam projection system of claim 8 wherein said laser projection is a cross projection.

* * * * *